United States Patent [19]

Iha

[11] Patent Number: 4,472,910

[45] Date of Patent: Sep. 25, 1984

[54] INTEGRAL DEVICE FOR GARAGE DOOR OPENER

[75] Inventor: Kiyoshi Iha, Elk Grove Village, Ill.

[73] Assignee: Chamnberlain Manufacturing Corporation, Elmhurst, Ill.

[21] Appl. No.: 428,340

[22] Filed: Sep. 29, 1982

[51] Int. Cl.[3] ..... E05F 15/00

[52] U.S. Cl. ..... 49/139; 49/200; 74/625; 160/189

[58] Field of Search ..... 49/139, 140, 200, 199; 160/193, 189; 74/625

[56] References Cited

U.S. PATENT DOCUMENTS

| | | | |
|---|---|---|---|
| 1,465,695 | 8/1923 | Stewart | 49/200 |
| 2,096,251 | 10/1937 | Knight et al. | 49/139 X |
| 2,841,724 | 7/1958 | Brown | 160/189 X |
| 2,882,044 | 4/1959 | Ginte | 160/189 X |
| 3,147,001 | 9/1964 | Purdy | 49/139 |
| 3,311,159 | 3/1967 | Stansberry | 160/189 |
| 4,085,629 | 4/1978 | Fogarollo | 49/139 X |
| 4,274,227 | 6/1981 | Toenjes | 49/199 X |

*Primary Examiner*—Philip C. Kannan

*Attorney, Agent, or Firm*—Hill, Van Santen, Steadman & Simpson

[57] ABSTRACT

An improved closure operator as for example for a garage door opener wherein a motor is coupled to the drive shaft of the door at one end thereof to drive pull-up and pull-down pulleys and a clutch mechanism is provided between the drive motor and the drive shaft which can be decoupled by moving a lever arm so as to disconnect the motor from the drive shaft to allow the door to be manually opened or closed as, for example, in the event of power failure. The unit results in a substantial simplification over prior art garage door operators which require a rail and trolley mechanism for opening and closing the door.

3 Claims, 4 Drawing Figures

FIG. 3
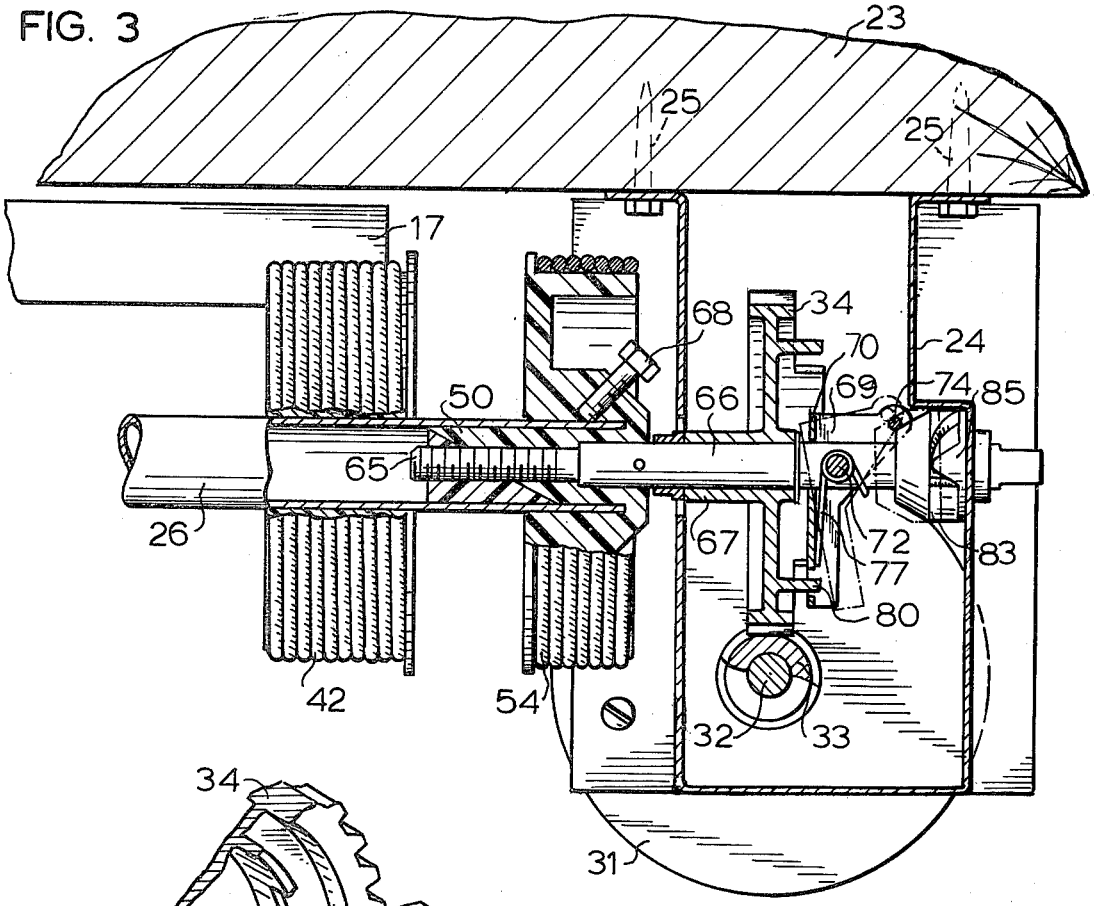
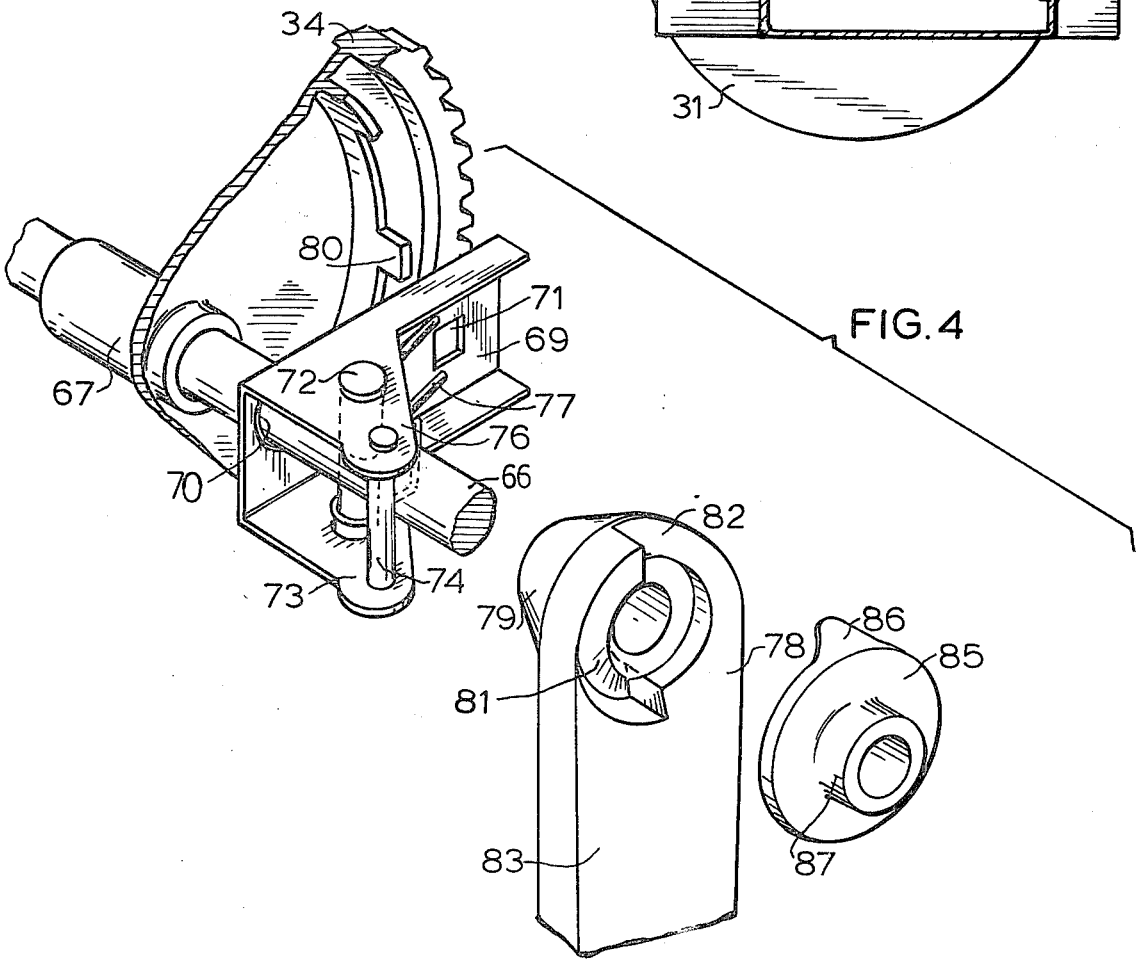
FIG. 4

INTEGRAL DEVICE FOR GARAGE DOOR OPENER

BACKGROUND OF THE INVENTION

1. Field of the Invention

This invention relates in general to garage door operators and in particular to a simplified drive means for a garage door operator which can be mounted at one end of the drive shaft to open and close the door and which eliminates many parts of prior art garage door openers.

2. Description of the Prior Art

Prior art garage door openers provide for a track which is mounted at the center of the door between the guide rails of the door and which carries a trolley which is moved either by a lead screw or a chain drive so as to move the trolley back and forth on the guide rail. The trolley is connected to the door and opens and closes the door as the trolley moves.

SUMMARY OF THE INVENTION

The present invention comprises an integral device for a garage door opener wherein a motor and clutch arrangement are attached to the drive shaft of the door at one end thereof which merely requires the attachment of a frame member which supports the motor to the header. A clutch mechanism is provided which allows the motor to be disconnected from the drive shaft of the door so that the door can be manually opened or closed in the event of power failure or under other conditions.

The invention results in a less expensive and simpler drive mechanism for a garage door operator than those of the prior art.

Yet another object of the invention is to provide an improved garage door operator which can be quickly and easily installed.

Other objects, features and advantages of the invention will be apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 3 is a partially cut-away sectional view of the garage door operator; and FIG. 4 is an exploded view of the drive and clutch mechanism of the invention.

DESCRIPTION OF THE PREFERRED EMBODIMENTS

Figure 1:
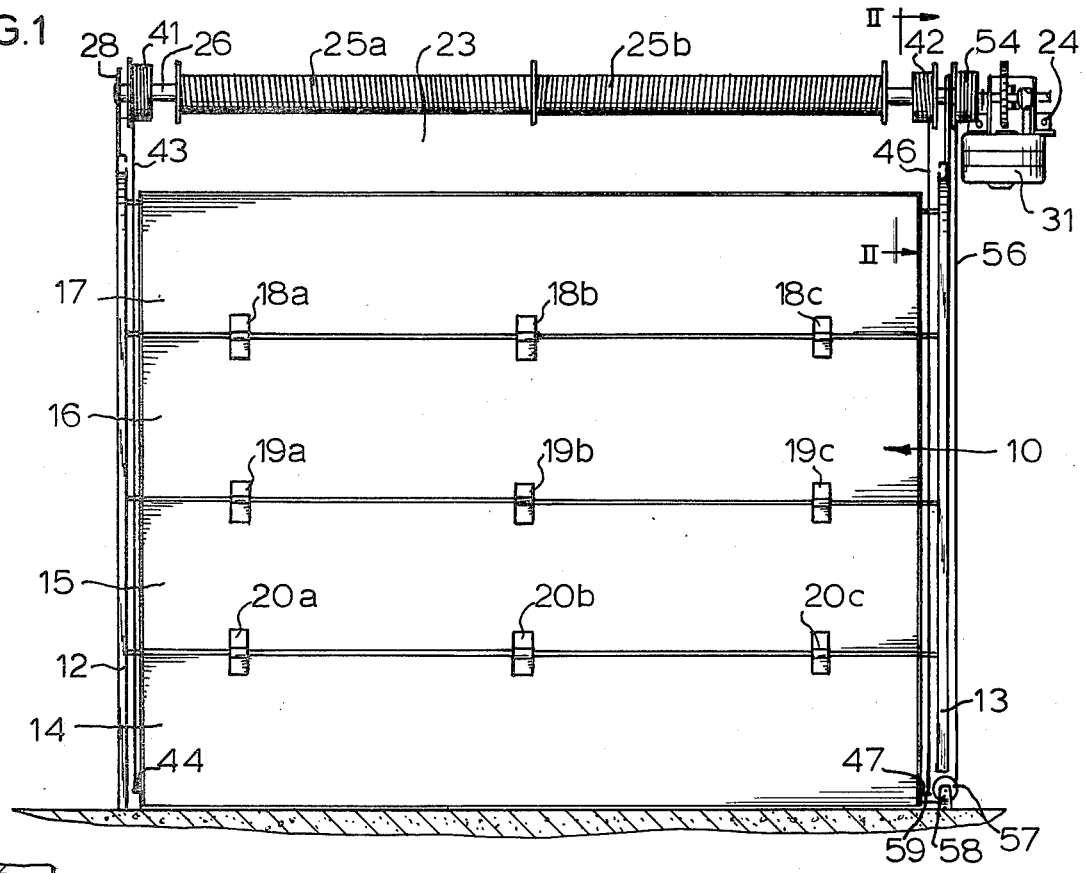
FIG. 1 is a plan view of the invention installed on a garage door.

FIG. 1 illustrates a garage door 10 which is formed with a plurality of panels 14, 15, 16 and 17 which are connected together by hinges 18, 19, 20. Generally, there are two or more hinges as illustrated by 18*a*, 18*b* and 18*c*, for example.

Figure 2:
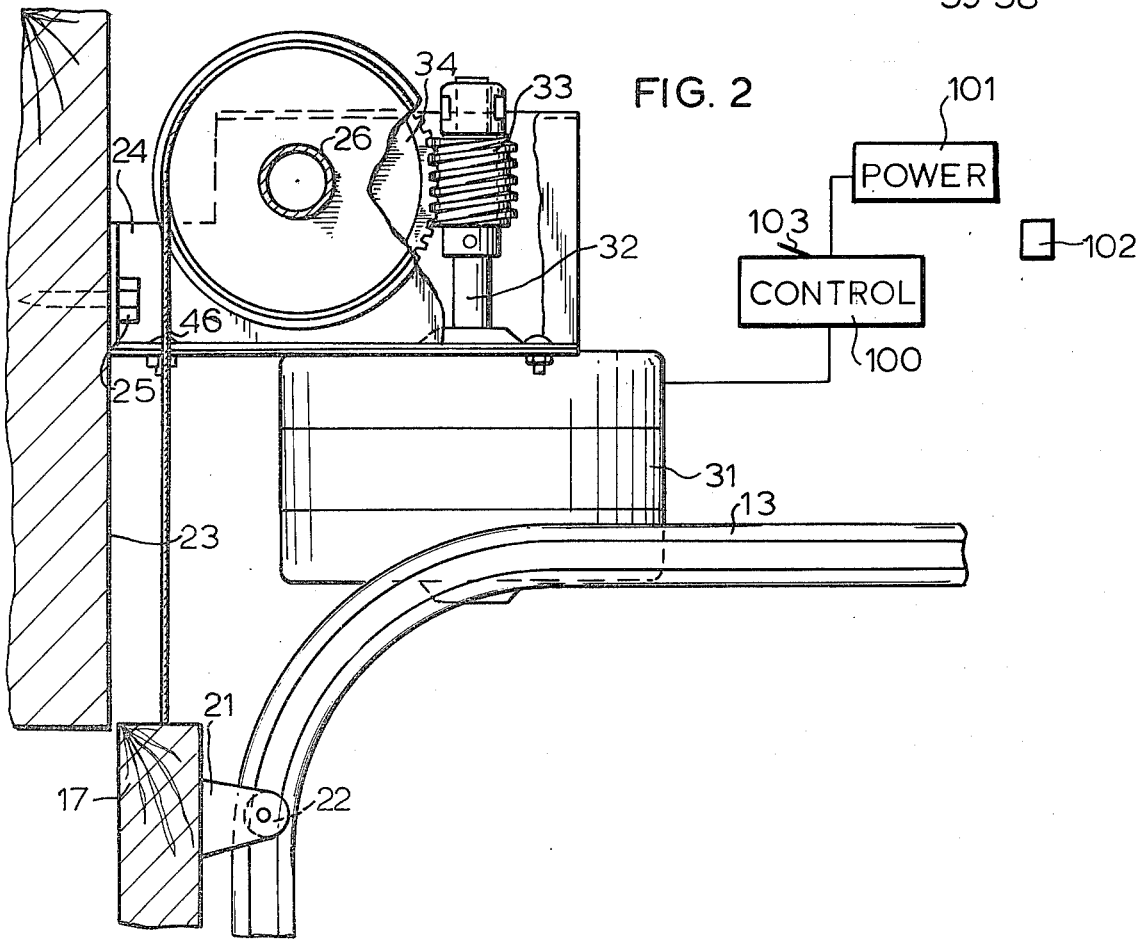
FIG. 2 is a sectional view taken on line II—II from FIG. 1.

The door 10 is provided with rollers 22 which are connected to the panels by brackets 21 as illustrated in FIG. 2 which ride in rails 12 and 13 in a conventional manner. A drive shaft 26 is supported by brackets 28 and 24 from the header 23 of the door and counter balance springs 25*a*, 25*b* are connected to the shaft 26 so as to counter balance the weight of the door in a conventional manner.

A pair of pull-up reels 41 and 42 are mounted on shaft 26 on opposite ends of the door 10 and respectively carry cables 43 and 46 which are connected to the lower panel 14 of the door at points 44 and 47 with suitable clamps.

In the invention a pull-down reel 54 is coupled to shaft 26 and carries a cable 56 which passes over a pulley 57 which is mounted at the bottom edge of the door by bracket 58. The cable 56 is connected to the lower panel 17 by clamp 59.

As shown in FIGS. 2 and 3, a motor 31 is mounted on bracket 24 and has an output shaft 32 which carries a worm 33 that mates with a drive gear 34 which is rotatably supported on a shaft 66. The shaft 66 has a threaded portion 65 which is threadedly received into a threaded portion 50 of shaft 26 such that the shafts 26 and 66 turn together. A latch member 69 is pivoted to the shaft 66 by a pin 72 which passes through the shaft 66 and is spring biased by a spring 77 to cause an opening 71 to receive a projection 80 formed on the side face of the gear 34 so as to lock the shafts 26, 66 and the gear 34 together when the projection 80 is received in the opening 71. An opening 70 is provided in latch member 69 and is larger than shaft 66 which extends therethrough so that latch member 69 can pivot relative to shaft 66.

A latch arm 83 is rotatably supported on a shaft 66 and has a conical-shaped surface 79 which engages a pin 74 that is mounted in portions 73 and 76 of the member 69. The latch member or arm 83 has a pair of cam surfaces 81 and 82 on the side opposite the member 69 which are engaged by a projection 86 of a latch member 85 which is rotatably supported on shaft 66 and is prevented from rotating by the frame 24. The cam surfaces 81 and 82 are such that when the latch member 83 is rotated, the conical portion 79 will move to the left relative to FIGS. 3 and 4 to engage pin 74, thus, causing the latch member 69 to pivot about the shaft 72 thus moving the projection 80 out of the opening 71 as the latch member 69 moves to the dotted position shown in FIG. 3. When the motor 31 is energized, it turns the worm 33 and the gear 34 and usually the latch arm 83 is in a position such that the conical surface 79 is to the right in the solid line position shown in FIG. 3 and, thus, the latch member 69 will have its opening 71 in engagement with the projection 80 of the gear 34 so that the gear 34 turns the latch member 69 and the shaft 66 and shaft 26. If the door is in the down position when the motor is energized, the shaft turns in a first direction so that the cables 43 and 46 will raise the door as the cables are wound around the pulleys 41 and 42. When the door has been opened a limit switch of conventional structure will turn the motor off. When the door is to be lowered the motor will turn shafts 26 and 66 in the opposite directions and the pull-down cable 56 will wind about pull-down reel 54 and close the door. A conventional limit switch will stop the motor when the door is closed. When the control 100 is energized either by a transmitter 102 or a local switch 103 power from power supply 101 is applied to the motor 31 to operate the door. The circuitry of the control 100 can be a conventional circuit such as used in garage door openers manufactured by the Chamberlain Manufacturing Corporation and as described in U.S. Pat. No. 4,274,227 and shown in FIG. 6 and such description and showing are hereby incorporated by reference. Such control circuits include up and down limit switches as well as obstruction sensing means for reversing the motor if the door encounters an obstruction.

At anytime it is desired to disconnect the motor 32 from the drive shaft 26 as for example when there has been a power failure, the lever arm 83 can be rotated to move the lever 69 to the dotted line position thus allowing the door to be manually opened or closed. When it is desired to reconnect the motor, the lever 83 is moved to the engaged position and the motor will be connected to shaft 26 through member 69.

Although the invention has been described with respect to preferred embodiments, it is not to be so limited as changes and modifications can be made which are within the full intended scope of the invention as defined by the appended claims.

I claim as my invention:

1. A closure operator for an overhead door comprising a pair of guide rails with vertical and horizontal portions in which the door is guided to open and close it, a frame member, a drive shaft rotatably supported by said frame member above the vertical portions of said rails, a motor means connected to drive said drive shaft in either direction to open and close said door, a pull-up cable attached to a lower portion of said door, a pull-up reel mounted on said drive shaft and said pull-up cable attached thereto, and a latch means connected between said motor means and said drive shaft and mounted at one end of said drive shaft to selectively disconnect them at any time and whether the motor means is energized or not, wherein said motor means is coupled to said drive shaft with a gear and said latch means selectively locks said gear to said drive shaft, wherein said gear is formed with a projection and is rotatably supported on said drive shaft and said latch means includes a latch lever pivoted to said drive shaft on a pivot which extends at right angles to the longitudinal axis of said drive shaft and formed with an opening into which said projection can be received to lock said gear to said shaft, wherein said lever is spring biased toward the projection of said gear, including a first cam member rotatably supported on said drive shaft and engageable with said latch lever and a second cam member rotatably mounted on said drive shaft and engageable with said first cam member, wherein said first cam member has a cam lever by which it can be rotated relative to said second cam member to disengage said projection from said latch lever, and wherein said second cam member is non-rotatably attached to said frame member.

2. A closure operator according to claim 1 including a counter balance spring means connected to said door to counter balance its weight.

3. A closure operator according to claim 2 including a pull-down reel mounted on said drive shaft, an idler puller rotatably supported adjacent the bottom of said door, and a pull-down cable attached to said door and passing over said idler pulley and connected to said pull-down reel.

* * * * *